United States Patent [19]

Anderson

[11] Patent Number: 4,537,004

[45] Date of Patent: Aug. 27, 1985

[54] INSULATED GLASS SPACER SUPPORT

[75] Inventor: Richard N. Anderson, Owensboro, Ky.

[73] Assignee: Hunter Douglas Inc., Totowa, N.J.

[21] Appl. No.: 460,564

[22] Filed: Jan. 24, 1983

[51] Int. Cl.[3] ..... E04C 2/34

[52] U.S. Cl. ..... 52/788; 52/398; 49/64

[58] Field of Search ..... 52/171, 172, 304, 397–401, 52/403, 788–791; 49/64; 160/107

[56] References Cited

U.S. PATENT DOCUMENTS

| | | | |
|---|---|---|---|
| 3,008,196 | 11/1961 | Springer et al. | 52/399 X |
| 3,022,549 | 2/1962 | Cummings | 49/64 |
| 3,030,673 | 4/1962 | London | 52/304 |
| 3,170,456 | 2/1965 | Moss et al. | 52/788 |
| 4,096,903 | 6/1978 | Ringle | 160/107 |
| 4,149,348 | 4/1979 | Pyzewski | 52/788 X |
| 4,226,063 | 10/1980 | Chenel | 52/788 |
| 4,429,509 | 2/1984 | Vachet et al. | 52/788 |

FOREIGN PATENT DOCUMENTS

| | | | |
|---|---|---|---|
| 2027717 | 12/1971 | Fed. Rep. of Germany | 160/107 |
| 1013519 | 4/1952 | France | 52/788 |
| 978316 | 12/1964 | United Kingdom | 49/64 |

*Primary Examiner*—J. Karl Bell

*Attorney, Agent, or Firm*—Pennie & Edmonds

[57] ABSTRACT

An insulated glass spacer support for use in an insulated glass structure. The support has fastener means thereon adapted to fasten a spacer element thereto which extends between opposed surfaces of two parallel spaced apart glazings. A portion of the support is adapted to extend over edges of the glazings such that the support resists any bending or deflection of the spacer elements due to bending forces that may be imparted on the spacer elements by a venetian blind assembly.

8 Claims, 8 Drawing Figures

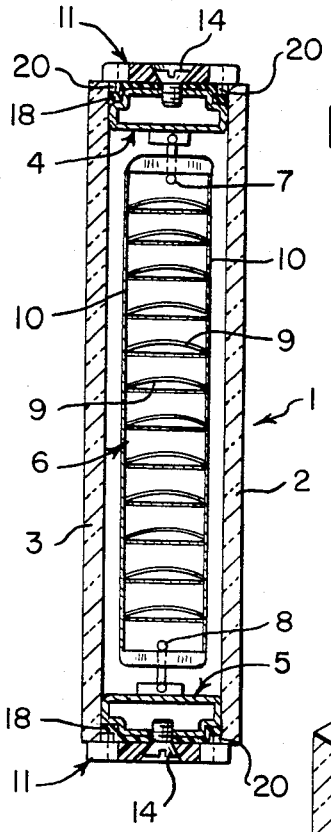
FIG. 1
FIG. 2
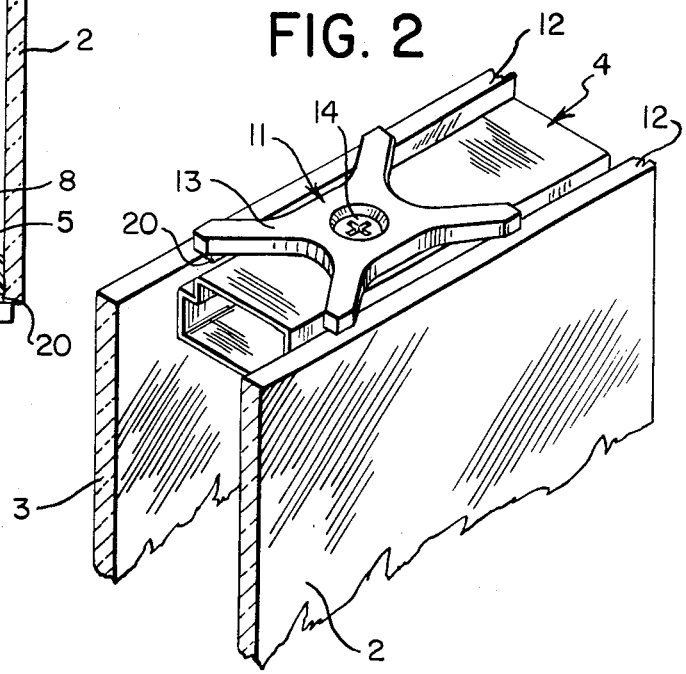
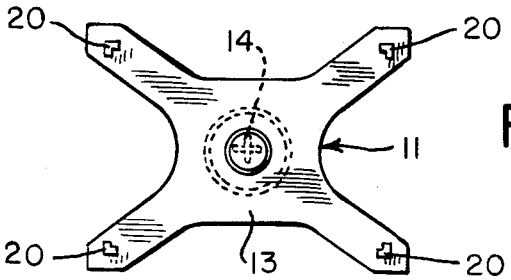
FIG. 3

FIG. 7
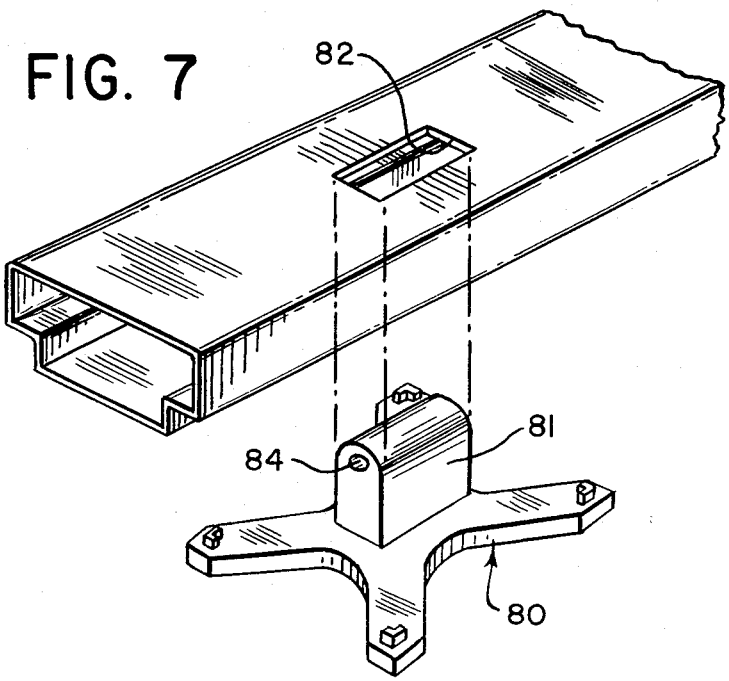
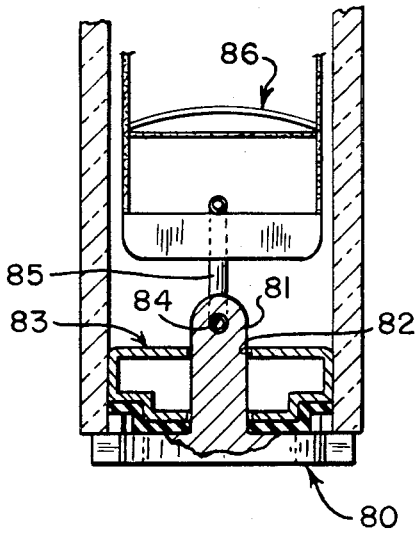
FIG. 8

INSULATED GLASS SPACER SUPPORT

FIELD OF THE INVENTION

This invention relates to an insulated glass spacer support and more particularly to a support for supporting spacer elements between two parallel spaced glazings.

BACKGROUND OF THE INVENTION

Insulated glass structures are known which comprise two spaced parallel glazings having spacer elements positioned around the periphery of the glazings and extending into the spacing between the glazings in order to position the glazings apart. Such constructions usually have a sealant applied between the spacer elements and glazings in order to hermetically seal the chamber formed by the space between the glazings. Often in such constructions venetian blind assemblies are suspended between end spacer elements positioned at opposite ends or sides of the insulated glass construction such that the blind assembly is positioned between the spaced glazings. In order to assure an aesthetically attractive blind assembly and to provide good tilt control, tape cables supporting the individual slats of the blind assembly are often tensioned. The tension forces in the cables is taken up or resisted by the spacer elements between which the venetian blind assembly is suspended and if, as is the usual case, the spacer elements are made of a light sheet metal construction, the elements may bend or deflect under the tension forces imparted by the tape cables. Such bending or deflection may result in loosening of the tape cables in turn causing poor tilt control and misalignment of slats to present a poor appearance. Further bending or deflection of a spacer element may break the seal between the sealant and the spacer element thus allowing leakage of air and moisture into the space formed by spaced parallel glazings.

The sealant is usually applied between a spacer element and the glazings under considerable pressure to insure elimination of voids. This pressure is sufficient in many instances to itself deflect a spacer element resulting in an unattractive appearance or contact with a blind assembly positioned between glazings. This latter problem is particularly objectionable when the spacer element is positioned adjacent the ends of the slats of a blind assembly since it may interfere with tilting or lifting of the slats.

While the end spacer elements between which a venetian blind assembly is suspended may be made of a heavier stronger material than sheet metal to withstand bending, this would necessarily increase manufacturing expense. The spacer elements often comprise hollow structures and while the voids within the structures could be filled with structural elements, the insertion of such elements would increase the cost of assembly and would fill spaces in which a desiccate material is normally positioned.

Other structural configurations of end spacer elements might be provided in order to increase the moment of inertia of the elements to resist bending forces, such as providing structural extensions extending from the bending plane either by shaping the spacer elements to provide an integral extension or by adding additional structure. This results however in decreasing the visible area of the insulated glass construction and making the spacer visibly more apparent. Further increasing the moment of inertia by shaping elements to provide integral extensions necessarily results in increased tooling expense and requires a special inventory of relatively expensive spacer elements which would differ in configuration from spacer elements not having a blind assembly suspended therebetween.

It is therefore an object of my invention to provide for an insulated glass spacer support which may be utilized with an existing spacer element from which a venetian blind assembly may be suspended where the support overcomes deflection or bending of the spacer element caused by tension or weight of a venetian blind assembly or which may be used to provide a support for a spacer element to prevent deflection due to pressure of a sealant bearing on the element.

GENERAL DESCRIPTION OF THE INVENTION

Broadly an insulated glass spacer support constructed according to my invention comprises a base which is adapted to overlie and contact a portion of the end edges at one end of spaced parallel glazings. The base has a fastener means thereon which is adapted to fasten to and to support an end spacer element extending parallel to the end edges and between the glazings and normally two or more supports would be fastened to a single end spacer element. The base extends only along a short portion of the edges and less than their complete length. This allows sealant to be inserted between the spacer element and the glazings about the periphery of the glazings after the glazings, spacer elements and supports have been assembled together.

Preferably the support includes locater means extending on one side of the base into the spacing between the two glazings and which is adapted to engage the inner opposed surfaces of the glazings. The locater means thus assures that the support will overlie the end edges of the glazings such that any forces tending to deflect or bend a spacer element fastened to the support as might result from a venetian blind assembly suspended therefrom will be taken up and resisted by the glazings or which might result from pressure of a sealant injected between the element and glazing.

The fastener means by which an end spacer element is fastened to the support may conveniently comprise a screw extending through the base to threadingly engage with a spacer element.

In a further form of the invention the fastener may comprise rails extending from the base into the space between the glazings to form a dove-tail shaped track. The spacer element may include a complimentary shaped head which may slide into the track such that the track supports the head. Sides of the rails may include a shoulder portion adapted to engage inner opposed surfaces of the glazings so as to form a locater means to assure that the support extends over the end edges of the glazings.

In some forms of the invention the support is adapted for use with U-shaped channel spacer elements having an open end. In this instance the fastener means of the support comprises lips extending from the base into the space between the glazing and which are adapted to engage with inturned ends of the U-shaped spacer element.

In still another form of the invention the support is connected directly to a pivot hanger by connection means which extends through an opening in a spacer element so that the blind assembly is supported directly by the support rather than through the spacer element.

The supports preferably are made of a plastic material or soft metal such as lead. This enables the support to also serve as a setting block around the perimeter of the glazings to minimize pressure cracks which might result from differential expansion of the various elements making up the insulated glass construction. It is desirable that the spacers including the locater means not have any sharp edges to minimize cracking of the glazings.

BRIEF DESCRIPTION OF THE DRAWINGS

FIG. 1 is a cross-sectional view of an insulated glass construction according to the invention having a venetian blind assembly therein;

FIG. 2 is a perspective view of a support constructed according to the invention supporting a spacer element between two parallel spaced glazings;

FIG. 3 is a bottom view of the support illustrated in FIG. 2;

FIG. 7 is a perspective exploded view of a further embodiment of a support constructed according to the invention adapted to be connected directly to a pivot hanger supporting one end of a venetian blind assembly; and, FIG. 8 is a cross-sectional view of the support of FIG. 7 assembled with a pivot hanger.

DESCRIPTION OF THE PREFERRED EMBODIMENTS

Figure 4:
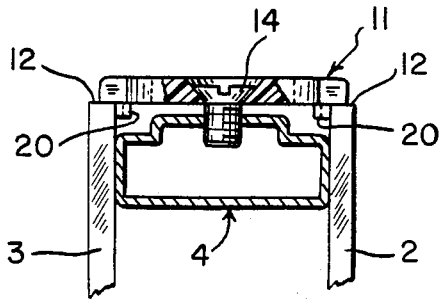
FIG. 4 is a partial cross-sectional view of the construction illustrated in FIG. 2.

Referring to FIG. 1 there is illustrated an insulated glass stucture 1 comprising two spaced parallel glazings 2 and 3 which are separated by an upper end spacer element 4 and a lower end spacer element 5 which are positioned between the glazings at their upper and lower ends. Side spacer elements, not shown, are positioned between the two glazing elements at opposite sides thereof and connect the upper and lower end spacer elements.

A venetian blind assembly 6 is suspended between the upper end spacer element 4 and the lower end spacer element 5 and is tiltably mounted therein by pivot hangers 7 and 8. The blind assembly includes a plurality of slats 9 which are supported by a suspension means comprising in part tape cables 10 extending between the pivot hangers 7 and 8 with tape cables 10 being tensioned.

As shown in FIGS. 2–4 the end spacer element 4 is fastened to a support 11 which overlies the end edges 12 of the glazings. The support 11 comprises an X-shaped base 13 in which, as shown in FIG. 2, the individual legs thereof overlie the edges 12 of the glazings.

The support 11 is provided with a fastener means comprising a screw 14 extending through the base to threadingly engage with an end spacer element 4. As is apparent in FIG. 2 the support 11 only extends along a small part of the edges 12. This allows a sealant 18 to be inserted between the inner surfaces of the glazings and the spacer element. The lower end spacer element 5 is fastened to a support 11 in the same manner as with the upper end spacer element. The sealant 18 is inserted along the complete length of both the upper and lower spacer elements as well as along the length of the side spacer elements, not shown, to provide hermetic sealing of the space between the glazings.

The support 11 includes locater means 20 on the bottom surface of the X-shaped base which are adapted to engage or contact the inner opposed surfaces of the glazings 2 and 3. These locater means assure that that X-shaped base will extend over the edges 12 during assembly of the parts prior to and while the sealant 18 is inserted into place. The sealant is preferably of an adhesive type so that it will hold the glazings to the spacer elements to provide for an insulated glass structure.

Figure 5:
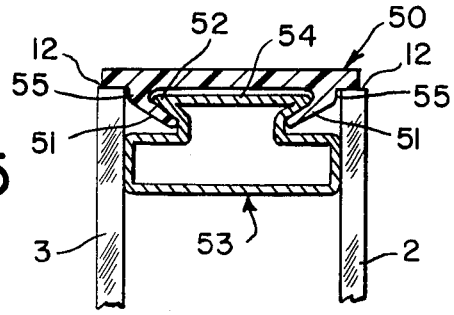
FIG. 5 is a cross-sectional view of a further embodiment of a support.

Referring to FIG. 5 a further embodiment of a spacer element and support is illustrated. As shown the support 50 has two inclined rails 51 extending into the space between the glazings 2 and 3 to form a dove-tailed track 52. Spacer element 53 has a complimentary-shaped head 54 by which the spacer element is fastened to the support. In assembly the support is slid over the end of the spacer element 53 to a desired position over the edges 12 of the glazings.

The sides 55 of the rails 51 serve as locater means to assure that the supports extend over the edges 12 during assembly of the insulated glass structure prior to and while a sealant, not shown, is inserted between the support and spacer element. Again, as with the embodiment of the support shown in FIGS. 1–4, the support 50 only extends along a small portion of the length of the edges 12 in order to allow convenient insertion of a sealant between the glazings and the end spacer elements.

Figure 6:
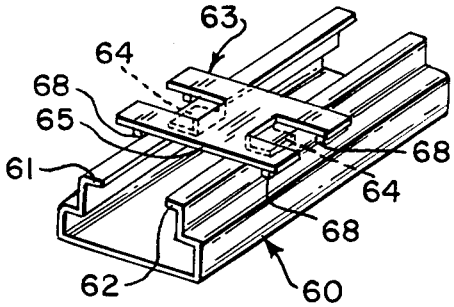
FIG. 6 is a perspective view of a still further embodiment of a support fastened to a U-shaped spacer element.

The embodiment of a support for use with a spacer having a U-shaped configuration is disclosed in FIG. 6. There a spacer element 60 is of a generally U-shaped configuration having inturned edges 61 and 62. A support 63 has lips 64 on the base portion 65 of the support which as shown are adapted to engage the inturned ends 61 and 62 to provide a fastening means by which the end spacer element 60 is fastened to the support. The support 63 is provided with locater means 68 similar to the locater means 20 of the support 11 to assure that the base 65 will extend over edges of glazings, not shown.

FIGS. 7 and 8 illustrate an X-shaped spacer 80 having a connecting means in the form of a post 81 adapted to extend through an opening 82 contained in a spacer element 83. The post 81 has a hole 84 therein adapted to pivotally engage a pivot hanger 85 from which one end of a blind assembly 86 is suspended. In this form of the invention tension forces existing in the blind assembly are transmitted directly to the support rather than through the spacer element as with the embodiment of FIGS. 1 and 2. This construction eliminates any need for a separate fastener to fasten a spacer element to a support or a separate clamp to connect a pivot hanger to a spacer element as is required in the construction shown in FIG. 1.

The supports of the embodiment shown are positioned along the upper and lower edges of glazings with as many supports provided as need be to overcome tension forces imparted by a venetian blind assembly to prevent deflection or bending of the upper and lower spacer elements. Preferably the supports are made of a plastic material or a soft metal such as lead to enable the supports to act as setting blocks to minimize pressure cracks occurring resulting from differential expansion of the various parts making up the insulated glass structure. Further any corners of the support and spacers should be rounded off to eliminate any sharp edges which might crack the glazings.

While the supports as shown in the drawings are fastened to upper and lower spacer elements between which a venetian blind having horizontally extending slats is extended, it is apparent that by turning the insulated glass construction that the end spacers would then become in effect side spacers and that the blind assembly would have the slats extending vertically such that the construction is applicable for use with vertically extending blinds.

The supports also may be used to fasten side spacer elements extending along the sides of glazings between upper and lower spacer elements. Such supports will prevent bending or deflection of the side spacer elements inwardly of the glazing edges when sealant is applied under pressure.

I claim:

1. An insulated glass spacer support for use in an insulated glass structure having two parallel spaced glazings separated along adjacent edges by a spacer element, said support including a base adapted to overlie and contact a portion of the adjacent edges of said glazings and extending less than the length of the adjacent edges, and fastener means on said base adapted to fasten to and support a spacer element extending parallel to said adjacent edges and between said glazings.

2. An insulated glass spacer support for use in an insulated glass structure according to claim 1 having in addition locater means on said base adapted to contact opposed surfaces of said glazings to position the base over the adjacent edges of said glazings.

3. An insulated glass spacer support for use in an insulated glass structure according to claim 1 wherein said base comprises curved arms forming an X-shape and wherein the free end of the arms are adapted to extend over said adjacent edges.

4. An insulated glass spacer support for use in an insulated glass structure according to claim 1 wherein said fastener means comprises a screw extending through said base adapted to threadingly engage a spacer element.

5. An insulated glass spacer support for use in an insulated glass structure according to claim 1 wherein said fastener means comprises inclined spaced rails forming a doved-tail shaped track adapted to extend between opposed surfaces of glazings and adapted to engage a complimentary shaped head on a spacer element.

6. An insulated glass spacer support for use in an insulated glass structure according to claim 5 wherein sides of said rails are adapted to contact opposed surfaces of said glazings to position the base over the adjacent edges of said glazings.

7. An insulated glass spacer support for use in an insulated glass structure according to claim 1 wherein said fastener means comprise two lips on the base adapted to extend between opposed surfaces of said glazings and adapted to engage inturned edges of a U-shaped spacer element.

8. An insulated glass spacer support for use in an insulated glass structure according to claim 1 wherein said fastener means comprises a post extending from said base adapted to extend through an aperture in a spacer element and connection means on the end of said post opposite said base adapted to pivotally engage a pivot hanger of a venetian blind assembly.

* * * * *